United States Patent [19]

Pugliese et al.

[11] 4,099,992

[45] Jul. 11, 1978

[54] TUBULAR PRODUCTS AND METHODS OF MAKING THE SAME

[75] Inventors: Leonard A. Pugliese, Murrysville; James P. Stroup, Ligonier Township, Westmoreland County, both of Pa.

[73] Assignee: Latrobe Steel Company, Latrobe, Pa.

[21] Appl. No.: 786,490

[22] Filed: Apr. 11, 1977

[51] Int. Cl.[2] ..... C21D 9/14

[52] U.S. Cl. ..... 148/11.5 N; 148/4; 148/32

[58] Field of Search ..... 148/11.5 N, 32, 4; 29/421 E

[56] References Cited

U.S. PATENT DOCUMENTS 4,026,583 5/1977 Gottlieb ..... 29/421 E

*Primary Examiner*—M. J. Andrews

*Attorney, Agent, or Firm*—Buell, Blenko & Ziesenheim

[57] ABSTRACT

Tubular metal products and methods of making tubular metal products for use in sour gas wells, which are characterized by resistance to hydrogen sulfide embrittlement at temperatures up to about 600° F., are provided based upon an alloy having the composition up to about 0.035% maximum carbon, up to about 0.15% maximum silicon, up to about 0.15% maximum manganese, up to about 0.010% maximum sulfur, up to about 0.015% maximum phosphorus, about 19.0% to about 21.0% chromium, about 33.0% up to about 37.0% nickel, about 9.0% to about 10.5% molybdenum, up to about 1.0% titanium, up to about 0.015% boron, up to about 2% iron and the balance cobalt, said tubular product having been heat treated in the range 1350° F. to 1500° F. after cold working up to about 75%.

6 Claims, 1 Drawing Figure

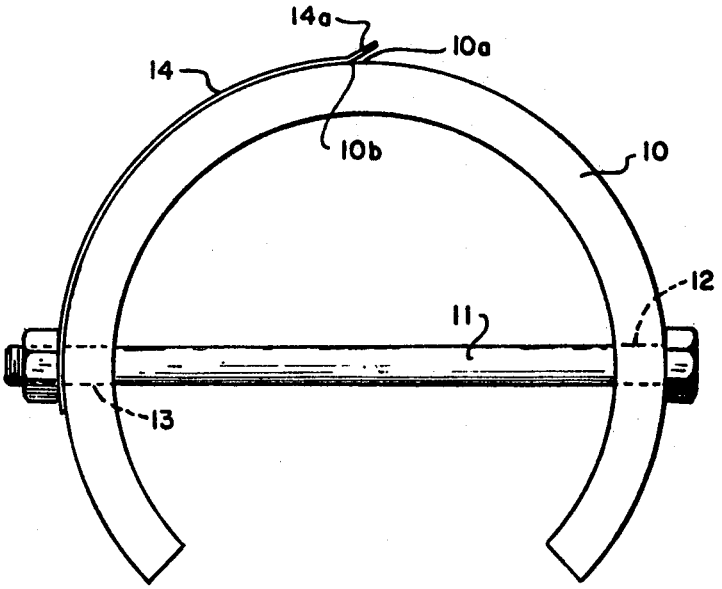
14a
10a
14
10b
10
12
11
13

TUBULAR PRODUCTS AND METHODS OF MAKING THE SAME

This invention relates to tubular products and methods of making the same and particularly to high strength pipe and tube which is resistant to corrosion and to hydrogen sulfide embrittlement at elevated temperatures.

There are known deposits of natural gas amounting to many trillions of cubic feet which are found at great depths and are highly contaminated with hydrogen sulfide and in a chloride solution environment. These deposits, generally known as "sour gas" deposits, are usually located at depths of up to 6 miles, at temperatures up to 600° F. Attempts to recover this gas have generally proven to be both uneconomical and very dangerous. Ordinary steel well casing and tubing is destroyed in days, in many cases, in this hostile environment. Moreover, the gas is extremely toxic and a failure in the handling pipe or tube which permits escape of the gas above ground can result in almost immediate death to anything which comes in contact with it. Attempts have been made to solve this problem using various compositions of the so-called "superalloys" without success. Here again the hostile environment of chloride solution, high temperature, carbon dioxide and hydrogen sulfide causes failure of the pipe or tubing in a very short time either from corrosion or as a result of embrittlement.

We have discovered that the alloy known in the trade as MP35N which is used to produce high strength fasteners, etc. when cold worked and aged at 1100° F. can, by a totally different treatment, not heretofore used or recognized, be formed into tubular products which have high strength and will retain their integrity in the hostile environment of a sour gas well. We have discovered that an alloy of the broad composition:

| | |
|---|---|
| C | up to about 0.035% max. |
| Si | up to about 0.15% max. |
| Mn | up to about 0.15% max. |
| S | up to about 0.010% max. |
| P | up to about 0.015% max. |
| Cr | about 19.0% to about 21.0% |
| Ni | about 33.0% to about 37.0% |
| Mo | about 9.0% to about 10.5% |
| Ti | up to about 1.00% |
| B | up to about 0.015% |
| Fe | up to about 2% |
| Co | Balance |

may be treated as hereafter described to produce tubular products which are compatible with the hostile environment of sour gas wells.

The preferred analysis of alloy for use in our invention is:

| | |
|---|---|
| C | up to about 0.020% max. |
| Si | LAP (lowest possible amt.) |
| Mn | LAP (lowest possible amt.) |

-continued

| | |
|---|---|
| S | LAP (lowest possible amt.) |
| P | LAP (lowest possible amt.) |
| Cr | about 20.50% |
| Ni | about 35.25% |
| Mo | about 9.80% |
| Ti | about 0.75% |
| B | about 0.010% |
| Fe | LAP (lowest possible amt.) |
| Co | Balance |

We have discovered that such alloys if cold worked in the range up to about 75%, preferably about 40% to 65% and heat treated in the range 1350° F. to 1500° F. for a minimum of one hour will withstand hydrogen sulfide embrittlement and yet have high strength.

The ability of a tubular member to withstand hydrogen sulfide embrittlement and failure in sour gas wells is usually measured by a C-ring sulfide stress cracking test. This test is performed by cutting a C-shaped ring of the alloy being tested, drilling opposing holes in the walls of the C-ring and inserting a bolt through the holes carrying a carbon steel shim which extends half way around the C-ring with its free end spaced from the center of the C-ring to form a crevice about one-eighth inch away from the center of the C-ring. A nut is tightened on the bolt to stress the C-ring and the ring is inserted in a standard NACE solution (National Association of Corrosion Engineer's solution) made up of oxygen free water containing 5% sodium chloride, 0.5% acetic acid and saturated with $H_2S$, simulating the sour gas well environment. A galvanic cell is formed between the steel shim and the C-ring. The C-ring is then checked periodically for cracking. Ordinary carbon steel tubing and all alloys presently known, with their existing treatments, fail this test in a matter of hours to a few days at high strength levels. This is true of the MP35N alloy above described when treated in the usual manner, i.e., 1100° F, for production of high strength articles. However, when treated according to this invention, the alloy is markedly improved in C-ring properties. The marked improvement is illustrated in the following example.

A series of C-rings were made up as shown in the attached drawing from the preferred alloy composition set out above.

Referring to the drawing we have illustrated a C-ring 10 made of the test alloy and having a bolt 11 of the same material extending through holes 12 and 13 on opposite ends of the C member 10. A carbon steel shim 14 is fixed at one end on bolt 11 and encircles the C member 10 to its midpoint **10*a* at which point the free end 14*a* of shim 14 forms a crevice at 10*b* about one-eighth inch away from midpoint 10*a*** and forms a galvanic cell when the assembly is immersed in the NACE solution. The test material was divided into six portions each of which was first cold worked and then portions of each were heat treated to the hardness and strength levels shown in the following table and made into C-rings for testing.

TABLE I

Unnotched C-ring Sulfide Stress Cracking Tests
NACE Solution - Room Temperature
3-½" O.D. MP35N Tubing

| | Average Rockwell C Hardness - Mid-thickness and 0.2% Y.S. (ksi) | | | | | | | | |
|---|---|---|---|---|---|---|---|---|---|
| Percent Cold Work | 1100° F/4 hr. | 1350° F/2 hr. | 1400° F/ 2 hr. | 1450° F/ 2 hr. | 1500° F/ 1 hr. | 1100° F/ 4 hr. + 1350° F/ 2 hr. | 1100° F/ 4 hr. + 1400° F/ 2 hr. | 1100° F/ 4 hr. + 1450° F/ 2 hr. | 1500° F/1 hr. |
| 40 | (3)41.4 (197.5) | 39.5 (184.0) | 39.2 (177.5) | 38.8 (177.1) | 38.6 (178.8) | 38.9 (184.7) | 39.3 (179.8) | 38.2 (171.9) | 39.3 (172.4) |

TABLE I-continued

Unnotched C-ring Sulfide Stress Cracking Tests
NACE Solution - Room Temperature
3-½" O.D. MP35N Tubing Average Rockwell C Hardness - Mid-thickness and 0.2% Y.S. (ksi)

| Percent Cold Work | 1100° F/4 hr. | 1350° F/2 hr. | 1400° F/ 2 hr. | 1450° F/ 2 hr. | 1500° F/ 1 hr. | 1100° F/ 4 hr. + 1350° F/ 2 hr. | 1100° F/ 4 hr. + 1400° F/ 2 hr. | 1100° F/ 4 hr. + 1450° F/ 2 hr. | 1500° F/1 hr. |
|---|---|---|---|---|---|---|---|---|---|
| 50 | (3)44.1 (223.8) | 42.9 (207.7) | 43.0 (207.2) | 43.0 (197.7) | 42.3 (200.7) | 43.1 (206.4) | 42.9 (208.8) | 41.9 (202.7) | 42.6 (197.5) |
| 56 | (2)44.2 (237.0) | 43.4 (216.0) | 42.6 (215.5) | 42.8 (204.0) | 41.7 (203.0) | 42.3 (216.3) | 42.6 (213.9) | 42.6 (207.4) | 42.6 (204.0) |
| 59 | (1)44.1 (247.5) | 43.2 (227.6) | 42.6 (221.4) | 42.6 (216.4) | 42.9 (214.3) | 43.9 (225.2) | 43.8 (220.4) | 43.8 (210.2) | 42.4 (210.0) |
| 65 | (1)45.2 (240.8) | 43.9 (222.6) | 43.3 (218.9) | 44.5 (211.8) | 41.9 (211.8) | 45.4 (221.8) | 44.9 (220.1) | 44.0 (207.7) | 43.3 (187.2) |
| 73 | (1*)47.9 (297.3) | (2*)47.7 (278.7) | 47.7 (261.1) | 45.9 (240.0) | 43.7 (220.0) | 47.8 (270.0) | 46.7 (260.2) | 46.6 (241.4) | (2*)44.3 (169.2) |

(1)Failed in ≦ 4 days
(2)Failed in 5-9 days
(3)Failed in 9-14 days
(1*)Failed in ≦ 2 days
(2*)Failed in 2-11 days
All other tests not marked with a number in parentheses did not fail in 100 days of exposure except for the 73% cold work series which were still in test after 65 days of exposure as of March 31, 1977.

It will be seen from the foregoing table that the alloy when cold worked at any level and heat treated at 1100° F. which is the treatment normally used to produce high strength products and is the normal treatment for this material, completely failed the C-ring test. On the other hand, the alloy when cold worked and heat treated according to this invention had not failed after 100 days of test when this application was executed. Prior to this invention, no alloy strengthened to these high levels had ever successfully lasted so long under this test.

In the foregoing specification we have set out certain preferred practices and embodiments of our invention, however, it will be understood that this invention may be otherwise embodied within the scope of the following claims.

We claim:

1. A tubular metal product for use in sour gas wells characterized by resistance to hydrogen sulfide embrittlement at temperatures up to about 600° F. consisting essentially of an alloy having the composition up to about 0.035% maximum carbon, up to about 0.15% maximum silicon, up to about 0.15% maximum manganese, up to about 0.010% maximum sulfur, up to about 0.015% maximum phosphorus, about 19.0 to about 21.0% chromium, about 33.0% up to 37.0% nickel, about 9.0% to about 10.5% molybdenum, up to about 1.0% titanium, up to about 0.015% boron, up to about 2% iron and the balance cobalt, said tubular product having been cold worked at least sufficiently to impart increased strength and up to about 75% and thereafter heat treated in the range 1350° F. to 1500° F.

2. A tubular metal product as claimed in claim 1 wherein the alloy composition is up to about 0.020% maximum carbon, lowest possible amount of silicon but not more than 0.15%, lowest possible amount of manganese but not more than 0.15%, lowest possible amount of sulfur but not more than 0.005%, lowest possible amount of phosphorus but not more than 0.010%, about 20.50% chromium, about 35.25% nickel, about 9.80% molybdenum, about 0.75% titanium, about 0.010% boron, lowest possible amount of iron but not more than 1% and the balance cobalt.

3. A tubular metal product as claimed in claim 1 wherein said product has been heat treated in the range 1400° F. to 1450° F. after cold working from 40% to 75%.

4. A method for producing a tubular metal product suitable for use in sour gas wells and characterized by resistance to hydrogen sulfide embrittlement at temperatures up to about 600° F. comprising the steps of (a) forming a tubular metal member from an alloy consisting essentially of up to about 0.035% maximum carbon, up to about 0.15% maximum silicon, up to about 0.15% maximum manganese, up to about 0.010% maximum sulfur, up to about 0.015% maximum phosphorus, about 19.0% to about 21.0% chromium, about 33.0% to 37.0% nickel, about 9.0% to about 10.5% molybdenum, up to about 1.0% titanium, up to about 0.015% boron, up to about 2% iron and the balance cobalt, (b) cold working said tubular metal member in the range about 40% to 75%, (c) heat treating said cold worked tubular member in the range 1350° F. to 1500° F. when the cold working is in the range 40% to 75%.

5. A method as claimed in claim 4 wherein the alloy consists essentially of up to about 0.020% maximum carbon, lowest possible amount of silicon but not more than 0.15%, lowest possible amount of manganese but not more than 0.15%, lowest possible amount of sulfur but not more than 0.005%, lowest possible amount of phosphorus but not more than 0.010%, about 20.50% chromium, about 35.25% nickel, about 9.80% molybdenum, about 0.75% titanium, about 0.010% boron, lowest possible amount of iron but not more than 1% and the balance cobalt.

6. A method as claimed in claim 4 wherein the cold working is in the range up to about 75% and the heat treating temperature is about 1400° F. to 1450° F.

* * * * *